US007392904B1

(12) United States Patent
Jackson

(10) Patent No.: US 7,392,904 B1
(45) Date of Patent: Jul. 1, 2008

(54) VARIABLE SIZE DOUBLE CRASH-LOCK CARTON

(75) Inventor: Gregory A. Jackson, Ballwin, MO (US)

(73) Assignee: Wunderlich Fibre Box Company, St. Louis, MO (US)

( * ) Notice: Subject to any disclaimer, the term of this patent is extended or adjusted under 35 U.S.C. 154(b) by 420 days.

(21) Appl. No.: 11/088,484

(22) Filed: Mar. 24, 2005

Related U.S. Application Data

(60) Provisional application No. 60/556,929, filed on Mar. 26, 2004.

(51) Int. Cl.
*B65D 85/50* (2006.01)

(52) U.S. Cl. ..... 206/423; 206/446; 206/490; 229/185; 229/117

(58) Field of Classification Search ..... 206/423, 206/486, 490, 592, 588, 446; 47/39, 84; 229/117, 183, 184, 185
See application file for complete search history.

(56) References Cited

U.S. PATENT DOCUMENTS 2,676,750 A * 4/1954 Gastright ..... 229/117
3,494,536 A * 2/1970 Henry ..... 229/117
3,851,815 A * 12/1974 Desmond et al. ..... 229/87.18
4,726,468 A 2/1988 Hesser et al.
4,819,803 A 4/1989 Neiser
4,993,318 A * 2/1991 Bollinger ..... 100/34
5,301,871 A * 4/1994 Gross et al. ..... 206/562
5,664,726 A * 9/1997 Opper ..... 229/117
2002/0179474 A1* 12/2002 Levieux et al. ..... 206/423
2006/0032898 A1* 2/2006 Mulcahy et al. ..... 229/117

* cited by examiner

*Primary Examiner*—David T Fidei
(74) *Attorney, Agent, or Firm*—Polster, Lieder, Woodruff & Lucchesi LC

(57) ABSTRACT

A carton having two opposed crush-lock ends, a flat bottom and opposed top with a substantially central opening which can accommodate receptacles having necks of varying diameters. The carton is designed to be shipped as a flat partially assembled blank which can be erected into a substantially rectangular box by pushing inwardly on the edges so the side panels of the box lock in substantially flat configuration. The top opening has outwardly radiating cut lines to define wedge shaped segments with an arcuate score line intersecting the segments whereby the segments can deflect and accommodate different sized receptacles.

10 Claims, 2 Drawing Sheets

VARIABLE SIZE DOUBLE CRASH-LOCK CARTON

CROSS REFERENCE TO RELATED APPLICATIONS

This application claims the benefit of U.S. provisional application Ser. No. 60/556,929 filed Mar. 26, 2004 which is incorporated herein by reference.

STATEMENT REGARDING FEDERALLY SPONSORED RESEARCH OR DEVELOPMENT

Not Applicable

BACKGROUND OF THE INVENTION

This invention relates to containers, and more particularly, to stabilizer boxes with a substantially center top opening, which may be adjustable in size to stabilize in an upright position and give shock resistant support to objects, usually cylindrical, having a variety of sizes. In particular, the invention relates to an adjustable carrier for floral containers, adopted to hold the floral container and its contents in an upright position during transportation.

When cut flowers are sold at a flower shop, grocery store, or the like, they often are sold with a vase which often is tall and thin, such as a bud vase. When these containers are carried in a vehicle, there is great danger of tipping and spillage.

Other types of products may also require support during shipment, such as crystal or chinaware, candle holders, bottles of medicine, packaged drugs, etc. The present invention also is suitable for packaging such products.

Its use for shipping bud vases is typical of other products also. The vases may have many different shapes, but are typified by long slender upright configurations which are top heavy when filled and may have many different surfaces and diameters at their necks.

U.S. Pat. No. 4,819,803 shows a formed box about a bud vase, wherein the box has curved openings which embrace the neck of the vase. U.S. Pat. No. 4,726,468 shows a box having a crush-lock bottom and hinged panels with curved ends which embrace the neck of a vase and are hinged downwardly to accommodate larger necks.

BRIEF SUMMARY OF THE INVENTION

The invention is embodied in a carton which has two opposed crush-lock ends, a flat bottom and a top which has a substantially center opening and may have cut lines radiating outwardly therefrom. In larger cartons, one or more score lines may be formed generally parallel to and outwardly spaced from the center opening to accommodate different sized vases in the carton. The invention also encompasses blanks from which the cartons are formed.

BRIEF DESCRIPTION OF THE SEVERAL VIEWS OF THE DRAWINGS

The objects of the invention are achieved as set forth in the illustrative embodiments shown in the drawings which form a part of the specification.

In the drawings wherein like numbers and letters refer to like parts wherever they occur.

DETAILED DESCRIPTION OF INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention. As various changes could be made in the above constructions without departing from the scope of the invention, it is intended that all matter contained in the above description or shown in the accompanying drawings shall be interpreted as illustrative and not in a limiting sense.

Figure 1:
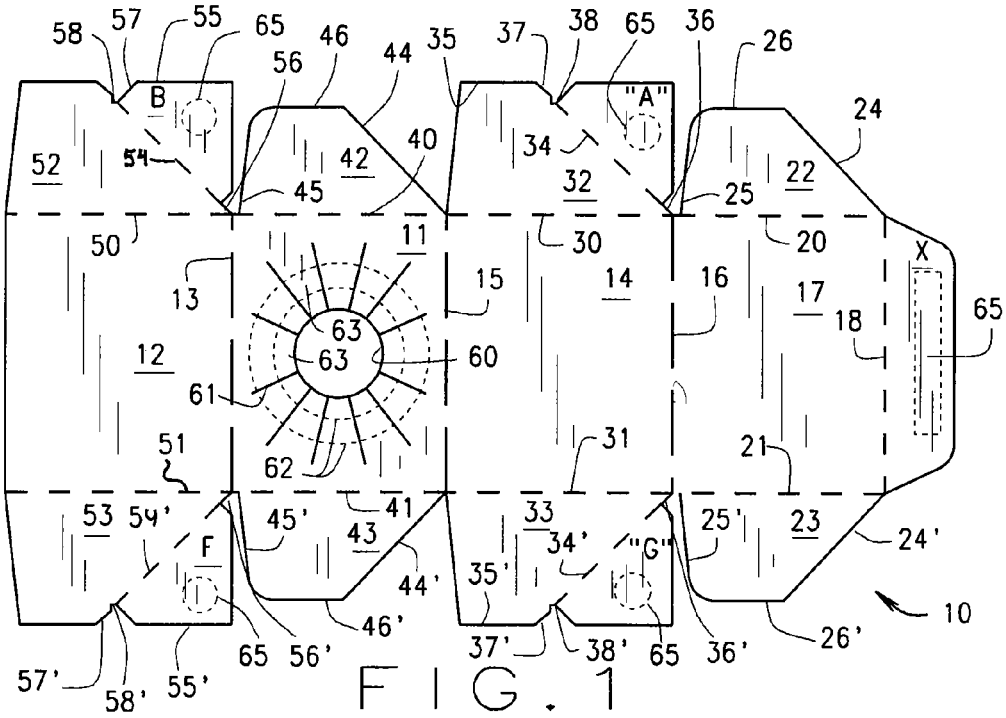
FIG. 1 is a plan view of the inside of a blank from which the box of this invention is made.

FIG. 1 shows a blank 10 from which a carton C (FIG. 5) of this invention is formed. The blank 10 comprises a top panel 11, a first end panel 12 hinged thereto by a first transverse score line 13, and a second end panel 14 hinged thereto by a second transverse score line 15 which is parallel to the first score line 13. Hinged to the second end panel 14 by a transverse score line 16 is a bottom panel 17 which is commensurate in size with the top panel 11. A glue panel "X" is hinged to the bottom panel 16 by a transverse score line 18 which is parallel to the score line 16. The glue panel X also could be connected to the first end panel 12.

Figure 2:
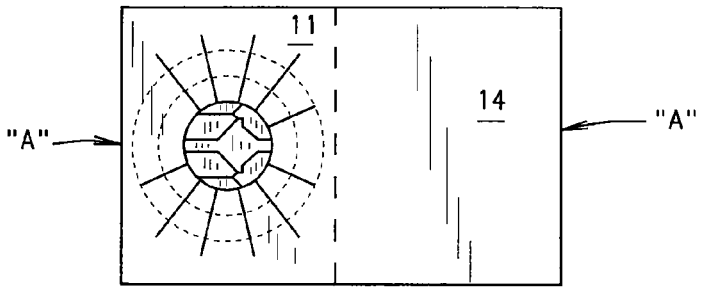
FIG. 2 is a plan view of the blank of FIG. 1 folded and glued and ready for shipment.

The other two sides of the carton C are formed of so-called "crash lock" ends and result from a series of panels and attached glue flaps hinged to the longitudinal edges of the panels 11, 12, 14 and 17. This allows the blank 10 to be folded and glued and still shipped in a flat configuration and erected and locked in a rectangular box-like configuration by pushing inwardly on the side edges. This configuration is shown in FIG. 2.

Attached to the bottom panel 17 by longitudinal hinges lines 20, 21 are opposed side panels 22, 23. The side panels 22, 23 have inwardly inclined side edges 24, 25, 24', 25' and connecting free edges 26, 26'.

Attached to the second end panel 14 by longitudinal score lines 30, 31 are opposed side panels 32, 33 which have foldable glue flaps "A", "G" attached thereto by score lines 34, 34' which are parallel to the side edges 24, 24'. The side panels 32, 33 have V-shaped cut outs 36, 36' where the score lines 34, 34' intersect the score lines 30, 31 and V-shaped cut outs 37, 37' where the score lines 34, 34' intersect the free edges 35, 35' of the panels 32, 33.

Locking notches 38, 38' are positioned at the base of the V-shaped cut outs 37, 37' to engage corresponding notches 58, 58' in the side panels 52, 53' attached to the first end panel 12 as will be described in detail hereinafter.

Attached to the top panel 11 by longitudinal score lines 40, 41 are opposed side panels 42, 43. The side panels 42, 43 have inwardly inclined side edges 44, 45, 44', 45' and connecting free edges 46, 46'.

Attached to the first end panel 12 by longitudinal score lines 50, 51 are the opposed side panels 52, 53 which have foldable glue flaps "B", "F" attached thereto by score lines 54, 54' which are parallel to the side edges 44, 44'. The side panels 52, 53 have V-shaped cut outs 56, 56' where the score lines 54, 54' intersect the score lines 50, 51, and V-shaped cutouts 57, 57' where the score lines 54, 54' intersect the free edges 55, 55' of the panels 52, 53.

Lock notches 58, 58' are positioned at the base of the V-shaped cutouts 57, 57' and are constructed and arranged to lockingly engage the lock notches 38, 38' respectively in the side panels 32, 33 when the carton C is formed in its erected position.

The edges 24 and 44 and the score lines 34 and 54 are all substantially parallel. The edges 25 and 45 are substantially parallel. The edges 24' and 44' and the score lines 34' and 54' are all substantially parallel. The edges 25' and 45' also are substantially parallel.

The top panel 11 is provided with a substantially center cut-out 60 and an area of cuts or slits 61 which radiate outwardly from the cut out 60 toward the edges of the panel 11 and define wedge shaped segments. One or more score lines 62 are positioned around and outwardly spaced from the cut out 60 and connect the cuts 61. The scores 62 and cuts 61 define bendable tabs 63 in the wedge shaped segments to accommodate vases or containers of different diameters.

To form the blank 10 into an item of commerce which can be shipped in flat condition, yet can be erected into a receptacle merely by pushing inwardly on the side edges, several glue flaps are attached together at the place of manufacture. In this instance, the glue flap "F" is attached to the outside of the side panel 43 by glue 65. The opposed glue flap "G" is attached to the outside of the side panel 23 by glue 65. At the other end of the blank 10, the glue flap "A" is attached to the outside of the side panel 22 by glue 65 and the glue flap "B" is attached to the outside of the side panel 42. Finally, the glue flap "x" is attached to the outside of the first end panel 12 by glue 65.

Figure 3:
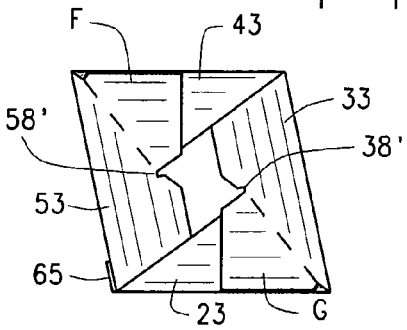
FIG. 3 is an end elevational view of the structure of FIG. 2 in partially erected form.

FIG. 2 shows the folded glued blank 10 ready for shipment;

FIG. 3 shows a partially erected carton C; and

Figure 4:
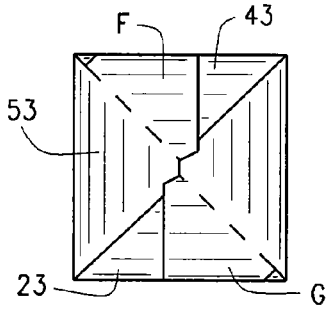
FIG. 4 is an end elevational view of the erected box.

FIG. 4 shows a fully erected carton C.

Figure 5:
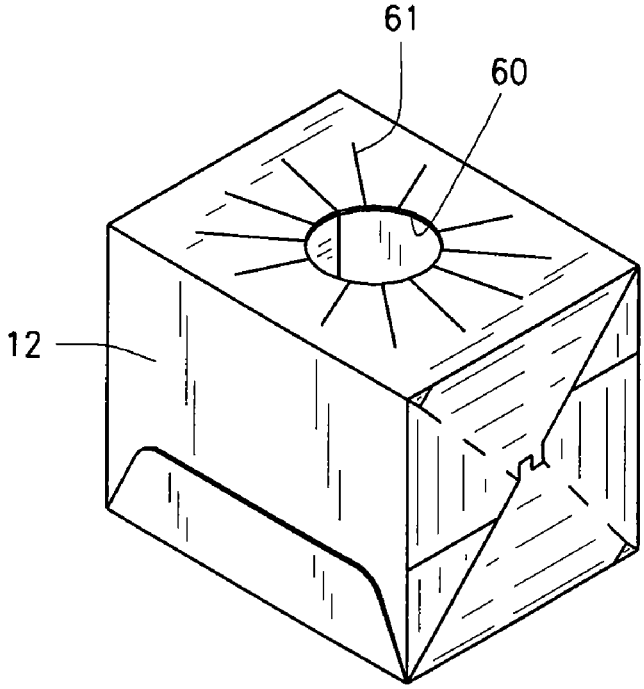
FIG. 5 is a perspective view of the erected box.

To erect the glued blank shown in FIG. 2 into the carton C shown in FIG. 5 the lock notch 38 is engaged in the notch 58 on one end of the carton C and the lock notch 38' is engaged in the notch 58' on the other end of the carton C. The ends of the glued blank 10 of FIG. 2 is erected into the carton C of FIG. 5 by pushing on the edges of the blank 10 as shown by the arrows "A" in FIG. 2.

Figure 6:
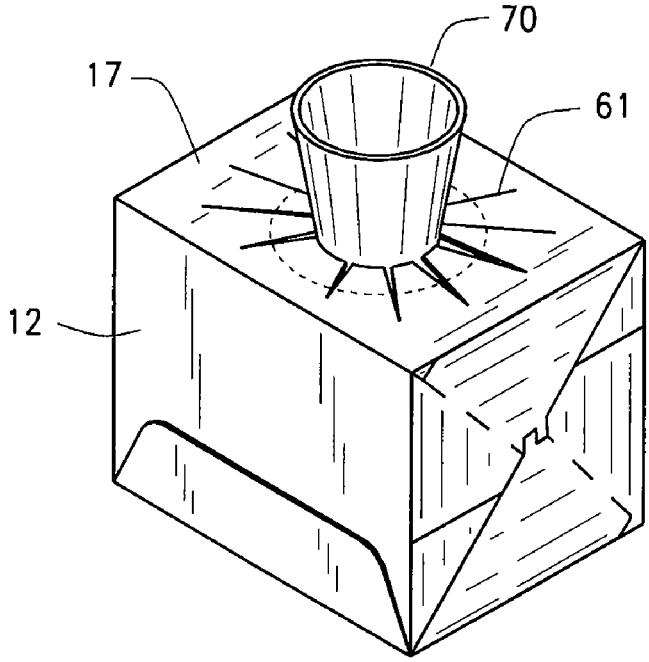
FIG. 6 is a perspective view of the box of FIG. 5 holding a receptacle.

FIG. 6 shows the carton with a receptacle 70 positional therein with the base of the receptacle 70 placed in the inside of the bottom panel 17.

The carton C preferably is made from 200 pound E-flute corrugated paperboard, but can be made from any suitable material. The interlocking tabs can be positioned on different panels so long as they cause the carton C to stay in erected locked position with interior flap supports.

In view of the above, it will be seen that the several objects and advantages of the present invention have been achieved and other advantageous results have been obtained. As various changes could be made in the above constructions without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. A blank for forming a double crush-lock carton when erected comprising:

a) a top panel having a substantially central cut-out with an area of cuts radiating outwardly from the central cut-out, the central cut out further having at least one arcuate score line in the area of cuts and substantially centered on the central cut-out, b) first and second end panels hingedly connected to the top panel along transverse edges of the top panel, c) a bottom panel hingedly connected to one of the first and second end panels along a transverse edge of said one first and second end panel, d) a glue panel hingedly connected to one of the first and second end panels or the bottom panel along an edge of the respective first and second end panels or the bottom panel to interconnect one of the first and second end panels to the bottom panel when the blank is erected into the carton, e) a side panel hingedly connected to opposing longitudinal edges of each of the top panel, the first end panel, the second end panel and the bottom panel, each side panel hingedly connected to the longitudinal edge of the respective first end panel and the second end panel includes a foldable glue flap wherein the top panel, the first end panel, the second end panel and the bottom panel are constructed and arranged to allow the blank to be shipped in flat condition and erected into a rectangular configuration by pushing inwardly on the first end panel and the second end panel.

2. The blank of claim 1 wherein the glue panel is connected to the bottom panel.

3. The blank of claim 1 wherein the glue panel is connected to one of the first and second end panels.

4. The blank of claim 1 wherein each glue flap is defined by diagonal score lines where the diagonal score lines intersect the free edges of the side panels of the first end panel and the second end panel and wherein the side panels of the first end panel and the second end panel each has a cut-out, each cut-out having a lock notch.

5. A glued flat blank for forming a double ended crush-lock carton when erected comprising:

a) a top panel having side flaps hingedly attached to longitudinal edges thereof by score lines, the top panel having a substantially central cut-out with an area of cuts radiating outwardly from the central cut-out, the central cut out further having at least one arcuate score line in the area of cuts and substantially centered on the central cut-out, b) first and second end panels hingedly attached to the top panel along transverse edges thereof, the first and second end panels having side panels hingedly attached to the first and second end panels by score lines along longitudinal edges thereof and having free edges opposite the attachments to the first and second end panels, the side panels each having glue flaps defined by diagonal score lines, each side panel having a cut-out where the diagonal score lines intersect the free edges of the side panels, c) a bottom panel hingedly connected to one of the first and second end panels along another transverse edge thereof and having other side flaps hingedly attached thereto by score lines along longitudinal edges thereof, and d) a glue panel for interconnecting the bottom panel and one of the first and second end panels, e) wherein the blank ships in a glued flat condition with the glue flaps on the side panels being attached to the adjacent side flaps on the top and bottom panels respectively, and the glue panel connects the bottom panel and one of the first and second end panels, the blank being erectable into a rectangular configuration by pushing inwardly on the first and second end panels and engaging the lock notches.

6. The blank of claim 5 wherein the glue panel is hingedly connected to the bottom panel along a transverse edge of the bottom panel.

7. The blank of claim 5 wherein the glue panel is hingedly connected to one of the first and second end panels along a transverse edge thereof.

8. A carton in the form of a solid rectangular shape for supporting an object in an upright position comprising:

a) a top panel, the top panel having a substantially center opening with cut lines radiating outwardly therefrom for accommodating the object to be supported, the cut lines defining wedge shaped segments and having at least one score line circumscribing the center opening and intersecting the cut lines to allow the portion of the top panel defined by the cut lines to deflect and accommodate objects of different sizes, b) a bottom panel, c) a first end panel, d) a second end panel, e) the top panel, the bottom panel, and the first and second end panels being connected along transverse edges, wherein opposed side panels of the top, bottom, first and second end panels and glue flaps hinged to longitudinal edges of the top, bottom and first and second end panels allow the carton to be shipped in a substantially flat condition and erected into a rectangular configuration by pushing inwardly on the first end panel and the second end panel.

9. The carton of claim 8 including a glue panel connected to one of the top panel, the bottom panel, the first or second end panels along a transverse edge thereof and connecting the glue panel to which it is attached to a free transverse edge of an adjacent panel.

10. The carton of claim 8 including a floral container positioned in the carton through the center opening with the base of the floral container positioned against an inside surface of the bottom panel and the wedge shaped segments in the top panel being deflected to bear against the floral container to retain the floral container in an upright position.

* * * * *